US005917101A

United States Patent [19]

Munoz

[11] Patent Number: 5,917,101

[45] Date of Patent: Jun. 29, 1999

[54] HEATING OIL COMPOSITION

[75] Inventor: Pedro Lopez Munoz, Mayaguez, Puerto Rico

[73] Assignee: Western Petroleum Enterprises, Inc., Mayaguez, Puerto Rico

[21] Appl. No.: 09/167,492

[22] Filed: Oct. 7, 1998

[51] Int. Cl.[6] ..... C07C 7/20

[52] U.S. Cl. ..... 585/14; 208/15

[58] Field of Search ..... 44/300; 585/1, 585/14; 208/15

[56] References Cited

U.S. PATENT DOCUMENTS

| | | | |
|---|---|---|---|
| 2,048,371 | 7/1936 | Calderwood . | |
| 2,858,200 | 10/1958 | Broughten . | |
| 3,522,169 | 7/1970 | Ireland | 208/15 |
| 3,620,961 | 11/1971 | Ireland | 208/15 |
| 3,660,058 | 5/1972 | Feldman et al. . | |
| 3,767,564 | 10/1973 | Youngblood et al. . | |
| 3,835,022 | 9/1974 | Frayer | 208/15 |
| 4,299,594 | 11/1981 | Pelrine et al. . | |
| 4,645,585 | 2/1987 | White . | |
| 4,853,337 | 8/1989 | Dickakian . | |
| 5,203,878 | 4/1993 | Woomer et al. . | |
| 5,389,112 | 2/1995 | Nikanjam et al. . | |
| 5,718,820 | 2/1998 | Morel et al. . | |
| 5,730,762 | 3/1998 | Murakami et al. . | |

*Primary Examiner*—Jacqueline V. Howard
*Assistant Examiner*—Cephia D. Toomer
*Attorney, Agent, or Firm*—Finnegan, Henderson, Farabow, Garrett & Dunner, L.L.P.

[57] ABSTRACT

The present invention is a heating oil composition for use typically in firing large boilers. Kerosene, diesel oil and Bunker 6 oil are blended to form the heating oil, which has a sulfur content of about from 0.3 wt. % to 0.6 wt. % and a heating value of about from 17,000 to 19,000 BTU/pound. The heating oil composition is both economical to manufacture and use, and reduces the emission of undesirable sulfur compounds.

3 Claims, No Drawings

HEATING OIL COMPOSITION

BACKGROUND OF THE INVENTION

1. Field of the Invention

The present invention relates to heating oil compositions for use in firing boilers or other heating units that must meet strict guidelines for emissions to the atmosphere, due to environmental concerns.

2. Description of the Related Art

The present invention provides a heating oil suitable for, inter alia, large boilers. These boilers may be used by manufacturers such as, for example, pharmaceutical manufacturers. Many petroleum-based heating oil mixtures have been used in the past, but they do not meet the requirements of the desired combination of adequate heating value, low sulfur emissions and economy. Such mixtures have been used as either fuel additives, or they have some combination of properties that does not meet environmental guidelines while being an economic fuel. These products are often a blend of various petroleum fractions, often designed to be a blend that reduces viscosity. Furthermore, some existing products are designed to reduce the amount of pollution thereby helping the environment, but at great expense.

One example of a fuel additive is U.S. Pat. No. 5,203,878 (No. '878) issued to Woomer et al. Similar to the present invention, this additive helps reduce pollutants to the environment. Additives are not used independently. They must be blended with fuel mixtures to achieve their goals. Indeed, the No. '878 patent achieves its goal by creating an additive. To be useful, that additive must be mixed with residual oils. The present invention, on the other hand, does not need to be blended with other fuels. Instead, it is used as a heating oil composition.

Another patent, U.S. Pat. No. 4,299,594, issued to Pelrine et al., discloses waste oils as a cutter stock to reduce the viscosity of oils. That invention employs waste oils in such a manner to reduce the need for valuable kerosene and gas oils. However, unlike the present invention, that patent does not use waste oils to lower the sulfur content. Furthermore, the No. '878 patent leads to the emission of other contaminants, such as lead, which need to be reduced in order to protect the environment.

Unlike the present invention, the prior compositions typically require either blending the product with a primary material to produce a heating oil, or they are merely additives to be mixed with fuels to achieve desired characteristics. Furthermore, the prior art does not address the specific objectives of this invention.

The present invention has several objectives. First, this invention provides a product with a sulfur content below 0.6% by weight to help reduce the amount of undesirable environmental emissions. At the same time, the invention permits a high enough level of sulfur to remain economically inexpensive to produce.

Accordingly, a second object of the present invention is to produce a heating oil more cheaply than the existing heating oils to result in less cost for operating boilers. Such economic efficiency may result in reduced expense of production for the consumers of the heating oil. This additional objective is assisted by yet another objective.

Another objective of the present invention is to maintain a high heating value. This high heating value may result in less fuel being required to operate a boiler. With less heating oil being required to operate a boiler, the boiler may operate at a lower expense. Accordingly, this objective of the present invention assists the second objective of reducing operating expenses of boilers.

The heating oil of the present invention is compatible with high sulfur diesel oil (0.5% sulfur content by weight). Therefore, this heating oil may be used as an alternative fuel.

Finally, an additional benefit of the present invention is maintenance of superior quality like that of clean prime products. Because of the high quality of the heating oil, the product of the present invention does not have to be mixed with other oils to achieve its objectives.

SUMMARY OF THE INVENTION

The objects of the invention are to produce a heating oil with low sulfur content to benefit the environment, yet be cost effective and have a high heating value. The heating oil of the present invention has a sulfur content of about from 0.3% to 0.6% by weight of sulfur and a heating value of about from 17,000 B.T.U./pound to 19,000 B.T.U./pound.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the present invention improves the prior art by providing an economic high yield fuel for large heaters that has a high heating value, while maintaining a sulfur content of about from 0.3% to 0.6% by weight. Additionally, the heating oil composition of the present invention is stable during storage, has good flow characteristics, and has a high flash point to meet the necessary requirements for safety and handling and to help comply with insurance and fire regulations. These achievements result in a commercially advantageous heating oil.

It is to be understood that both the foregoing general description and the following detailed description are exemplary and explanatory only and are not restrictive of the invention, as claimed.

DESCRIPTION OF THE PREFERRED EMBODIMENT

Reference will now be made in greater detail to the present preferred embodiment of the invention.

In accordance with the present invention, there is blended together a mixture of kerosene having a sulfur content of not more than about 0.2 wt. %, low sulfur diesel oil having a sulfur content of not more than about 0.05 wt. %, and Bunker 6 oil having a sulfur content of about from 1.5 to 2 wt. %.

For the purposes hereof, the terms kerosene, low sulfur diesel oil, and Bunker 6 oil mean the following petroleum-derived products. Kerosene has a boiling range of from an initial boiling point of about 150° F. to an ending point of about 572° F. Typically, kerosene will have a flash point range of about from 38.7 to 65.5° C., a viscosity of about 1.9 cSt at 40° C., and a heating value of about 18,500 BTU/pound. Diesel oil has a boiling range of from an initial boiling point of about 175° F. to an ending point of about 690° F. Typically, diesel oil will have a flash point of about from 110 to 190° C., a viscosity of about 3 cSt at 37.7° C., and a heating value of about 18,300 BTU/pound. Bunker 6 oil has a boiling range of from an initial boiling point of about 200° F. to an ending point greater than about 1000° F. Typically, Bunker 6 oil will have a flash point of over about 150° C., a viscosity of about from 92 to 530 cSt at 122° F., a pour point of about 55° F., and a heating value of about 17,600 BTU/pound.

A particularly preferred embodiment of the present invention blends a mixture of about from 53 to 73 vol. % kerosene, with about from 5 to 20 vol. % low sulfur diesel oil and about from 17 to 37 vol. % Bunker 6 oil. A more preferred embodiment of the present invention blends a mixture of about from 58 to 68 vol. % kerosene, with about from 5 to 15 vol. % low sulfur diesel oil and about from 22 to 32 vol. % Bunker 6 oil. An even more preferred embodiment of the present invention blends a mixture of about 63 vol. % kerosene, with about 10 vol. % low sulfur diesel oil and about 27 vol. % Bunker 6 oil.

The blending process proceeds in the following manner. First, the prime material, kerosene, diesel oil, and bunker oil, are individually analyzed to determine the quality of each material. This analysis entails ensuring the that prime materials meet the product specifications.

Next, following the analyses of the prime materials, the percentages of the prime materials required for the heating oil are estimated. These percentages may then be adjusted, if necessary, for the purpose of achieving the sulfur content and heating value desired. Specifically, the percentage of prime materials may be adjusted to achieve a sulfur content of about from 0.3% to 0.6% by weight, and a heating value of about from 17,000 to 19,000 BTU/pound.

After the proper percentages of each of the prime materials are determined for the blend, the prime materials are then blended and intimately mixed. During blending, the product may be recirculated to achieve complete blending and a homogenized product.

After the product has been recirculating for about 24 hours, samples of the product are removed and analyzed to determine the quality of the product. If the product meets specifications, it may be released to holding tanks or trucks for sale.

Table 1 shows typical average values for sulfur content and heating value based upon typical average values of the prime materials and the composition of the present invention.

TABLE 1

| | Bunker oil | Kerosene | Diesel | Present Invention |
|---|---|---|---|---|
| Flash | 188.5 | 123 | | 149 |
| Viscosity CST | 357 | 1.8 | 3.6 | 4.72 |
| Sulfur | 1.57 | 0.16 | 0.011 | 0.48 |
| Gravity | 16.2 | 39.4 | 33.2 | 30.6 |
| Pour Point | 30 | | 10+ | 19− |
| Ash | 0.08 | 0.03 | 0.03 | 0.012 |
| Heating Value | 17,672 | 18,447 | 18,317 | 18,402 |

Table 2 illustrates typical analyses of the present invention. These analyses were taken from different production lots. As can be seen, the sulfur content by weight varied from a minimum of 0.37% to a maximum of 0.54%. The heating energy varied from about 18,100 to about 18,300 B.T.U./pound.

TABLE 2

| | Sample 1 | Sample 2 | Sample 3 | Sample 4 |
|---|---|---|---|---|
| Gravity at 60° F. | 31.9 | 34.2 | 34.5 | 34.1 |
| Flash Point/° F. | 138 | 132 | 136 | 146 |
| Visc. cSt @ 50° C. | 3.82 | 3.76 | 3.41 | 3.17 |
| Sulfur, wt % | 0.50 | 0.55 | 0.47 | 0.37 |
| Ash, wt % | 0.03 | 0.02 | 0.03 | 0.03 |
| Pour Point/° F. | −20 | −20 | −20 | −15 |
| Heat Content | | | | |
| BTU/lb (net) | 18,148 | 18,227 | 18,249 | 18,181 |
| BTU/L (gross) | 19,288 | 19,404 | 19,426 | 19,358 |

The present invention may be performed using commercially available kerosenes, low sulfur diesel oils, and Bunker 6 oil. The invention is best performed using a standard kerosene with a sulfur content of not more than about 0.2% by weight. The sulfur content is preferred to be about 0.16% by weight in the kerosene. The diesel oil should be a low sulfur diesel with a sulfur content of not more than about 0.05% by weight. The preferred sulfur content in the diesel oil is 0.0011% by weight. The Bunker oil No. 6 should have a sulfur content of not more than about 2% by weight. Because sulfur content of the starting materials may vary, the ratio of the starting materials may vary correspondingly to achieve the desired level of sulfur of the present invention.

The invention will be further clarified by the following example, which is intended to be purely exemplary of the invention. In one instance, heating oil of the present invention was manufactured by blending 63% kerosene having a 0.16 wt. % sulfur content with 27% Bunker 6 oil having a 1.4 wt. % sulfur content and 10% diesel oil having a sulfur content of 0.02 wt. %. The resulting heating oil had a sulfur content of 0.44 wt. % and a heating value of 18,228 BTU/pound. Furthermore, the resulting heating oil had a flash point of 154° F., a viscosity of 6.98 cSt at 50° C., and a pour point of −15° F.

It will be apparent to those skilled in the art that various modifications and variations can be made in the fuel oil of the present invention without departing from the scope or spirit of the invention. As an example, the Bunker oil No. 6 could be replaced by another bunker oil meeting the requirements of the specification.

Other embodiments of the invention will be apparent to those skilled in the art from consideration of the specification and practice of the invention disclosed herein. It is intended that the specification and examples be considered as exemplary only, with a true scope of the invention being determined by the following claims and their equivalents.

What is claimed is:

1. A heating oil consisting essentially of a blend of kerosene, diesel oil and Bunker 6 oil, which heating oil has a sulfur content by weight of from about 0.3% to about 0.6%, and a heating value of from about 17,000 to about 19,000 B.T.U./pound.

2. A heating oil consisting essentially of a blend of kerosene, diesel oil and Bunker 6 oil formed by intimately mixing:

from about 53 to about 72 vol. % of kerosene containing not more than about 0.2% by weight sulfur;

from about 17 to about 37 vol. % of Bunker 6 oil containing not more than about 2% by weight of sulfur; and from about 5 to about 20 vol. % of diesel oil containing not more than about 0.05% by weight of sulfur;

wherein said heating oil has a sulfur content of from about 0.3% to about 0.6% by weight of sulfur; and wherein said heating oil has a net heating value of from about 17,000 to about 19,000 B.T.U./pound.

3. A heating oil consisting essentially of a blend of kerosene, diesel oil and Bunker 6 oil formed by intimately mixing:

about 63 vol. % of kerosene containing about 0.16% by weight sulfur;

about 27 vol. % of Bunker 6 oil containing from about 1.5% to about 2% by weight of sulfur; and about 10 vol. % of diesel oil containing about 0.02% by weight of sulfur;

wherein said heating oil has a sulfur content of from about 0.3% to about 0.6% by weight of sulfur; and wherein said heating oil has a net heating value of from about 17,000 to about 19,000 B.T.U./pound.

* * * * *